US006859945B1

(12) United States Patent
Crawford

(10) Patent No.: US 6,859,945 B1
(45) Date of Patent: Mar. 1, 2005

(54) BELT LOOP COVER

(76) Inventor: Lynda D. Crawford, P.O. Box 76, Cerrillos, NM (US) 87010

( * ) Notice: Subject to any disclaimer, the term of this patent is extended or adjusted under 35 U.S.C. 154(b) by 0 days.

(21) Appl. No.: 10/327,494

(22) Filed: Dec. 20, 2002

Related U.S. Application Data

(60) Provisional application No. 60/343,099, filed on Dec. 21, 2001.

(51) Int. Cl.[7] ..... A41F 1/00

(52) U.S. Cl. ..... 2/336

(58) Field of Search ..... 2/338, 310, 311, 2/336, 319, 312–318, 300, 267, 268, 227, 79

(56) References Cited

U.S. PATENT DOCUMENTS

| | | | | | |
|---|---|---|---|---|---|
| 710,292 | A | * | 9/1902 | Mudd | 2/319 |
| 3,848,270 | A | * | 11/1974 | Rand | 2/311 |
| 4,879,768 | A | * | 11/1989 | McClees et al. | 224/264 |
| 4,887,318 | A | * | 12/1989 | Weinreb | 2/268 |
| 5,852,829 | A | * | 12/1998 | Relaford | 2/338 |
| 6,026,515 | A | * | 2/2000 | Nielson et al. | 2/244 |
| 6,473,941 | B2 | * | 11/2002 | Mei et al. | 24/3.1 |

* cited by examiner

*Primary Examiner*—Tejash Patel
(74) *Attorney, Agent, or Firm*—Deborah A. Peacock; Vidal A. Oaxaca; Peacock Myers & Adams, P.C.

(57) ABSTRACT

The invention is a belt loop cover. The belt loop cover is preferably attachable to and detachable from a belt loop and provides a decorative element for clothing. Various optional attachment systems attach the belt loop cover to the belt loop.

17 Claims, 3 Drawing Sheets

BELT LOOP COVER

CROSS-REFERENCE TO RELATED APPLICATIONS

This application claims the benefit of the filing of U.S. Provisional Patent Application Ser. No. 60/343,099, entitled "Belt Loop Cover," filed on Dec. 21, 2001, and the specification thereof is incorporated herein by reference.

BACKGROUND OF THE INVENTION

1. Field of the Invention (Technical Field)

The present invention relates to belt loop covers.

2. Background Art

Decorative belts have been made in the prior art in order to dress up clothing items that have belt loops. However, the belt loop itself has generally not been the focus of any decoration.

The present invention provides an element that is positioned or disposed on a belt loop providing a decorative element for the belt loop. Preferably, the belt loop cover is attachable to and detachable from the belt loop.

SUMMARY OF THE INVENTION (DISCLOSURE OF THE INVENTION)

The present invention is a belt loop cover comprising a front face disposable on a front of a belt loop and a back attachment disposable on a back of the belt loop. The belt loop cover may be flat, curved or other shape.

A design may be on the belt loop cover at the time of manufacture, or it may be a blank so that an artist or designer can add a design after manufacture.

The belt loop cover may comprise longitudinal rails on each side of the belt loop cover. The rails are attachable and detachable to the back of the belt loop.

Alternatively, the back attachment may comprise at least one bendable tab. These tabs are attachable and detachable to the back of the belt loop. There may be two tabs, one at a top of the belt loop cover and one at a bottom of the belt loop cover. Or, two tabs may be on each side of the belt loop cover. Such tabs may be in an opposing configuration and may be rectangular or triangular or other shapes. Alternatively, there may be four tabs, two at a top of the belt loop cover and two at a bottom of the belt loop cover.

In an alternative embodiment, the belt loop cover attachment comprises a tab and a catch, wherein the tab is bendable around the belt loop and positioned under a catch.

In yet another embodiment, the belt loop cover comprises three tabs, one tab at one end of the belt loop cover and two at another end of the belt loop cover.

In another embodiment, the back attachment comprises a penetrator and cover or cap attachment.

Rather than metal or other bendable semi-rigid material, the back attachment may comprise a hook and loop system.

The belt loop cover may be of any shape. The preferred shape is a rectangular shape closely approximating the shape of the belt loop.

It is an object and advantage of the present invention to provide a decorative element for belt loops that is easy to attach and detach.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

A brief description of the drawings follows.

Figure 1:
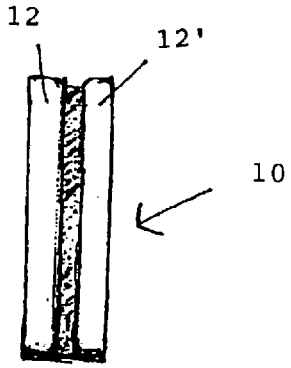
FIG. 1 shows a preferred back view of a one-piece belt loop cover of the present invention.

DESCRIPTION OF THE PREFERRED EMBODIMENTS (BEST MODES FOR CARRYING OUT THE INVENTION)

The present invention comprises a belt loop cover. Several variations are described herein. The preferred belt loop cover is one piece and is preferably metallic or other material that can be easily attached to and detached from a belt loop. The preferred shape is substantially rectangular in form, but it may have any face or front shape. Various face shapes include circular, oval, rectangular, square and the like.

A curved or flat face accepts any graphic design format or indicia, e.g., engraving stamps, logos, overly. Inlay, filigree, and the like, depending upon the artistic or advertising expression of choice.

Although flat and curved faces are shown in the drawings, other shapes and textures may be utilized in accordance with the present invention, such as stepped shapes, wavy shapes, or other contours, bumps, and the like. The invention is not limited to the embodiments shown in the drawings.

The belt loop covers of the present invention are made of various materials, preferably metals or alloys (e.g. copper and gold) although silver and silver alloys are the metals of choice as they retain their beautiful luster, are long wearing and washable. The "covers" are preferably removable from the belt loop and designed as an accessory, providing easy transfer from one garment to another.

Figure 11:
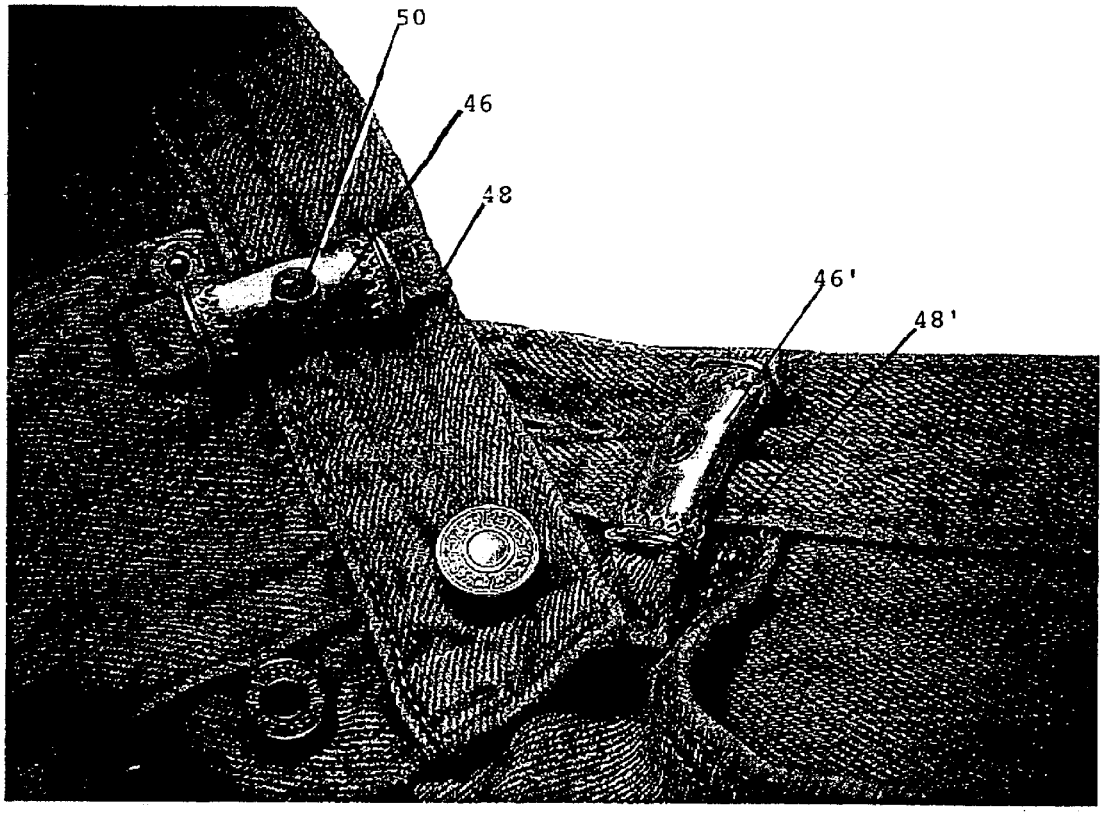
FIG. 11 shows two belt loop covers attached to jeans belt loops.

The preferred embodiment is intended as an embellishment on jeans or khaki belt loops as shown in FIG. 11, wherein belt loop cover 46, 46' is disposed on belt loop 48, 48'. This particular belt loop cover design 46 has a stone 50 disposed therein. However, the belt loop covers of the present invention are adaptable to any size belt loops including loops on dress trousers, riding pants, slacks or skirts, coats, or any other clothing having a belt loop.

FIG. 1 shows the preferred belt loop cover 10 of the present invention, i.e., a one-piece configuration of two, parallel, vertical, in-turned flaps 12, 12' running down the back of the belt loop cover 10. Rails 12, 12' are sized to allow accommodation and containment of each individual belt loop in a simple sliding and locking motion.

The preferred dimensions of belt loop covers for jeans and khakis are approximately ½ inch in width and 1-¾ inch in length. Each back flap is preferably approximately ¼ inch and the space between the sides forms an opening for the belt loop to glide into. These dimensions can and will vary depending upon stylized versions of the belt loop and belt loop cover. Such an example is the specific size belt loops found on equestrian riding pants.

Figure 2:
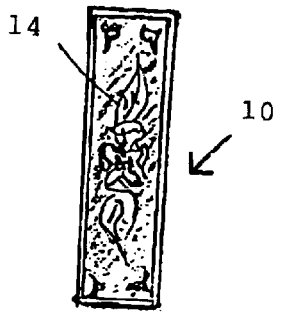
FIG. 2 shows a face of a rectangular belt loop cover that accepts an artist's choice of design expression.

FIG. 2 shows a face 14 of belt loop cover 10. Face 14 may have any decoration or will accept an artist's choice of design expression.

Figure 3:
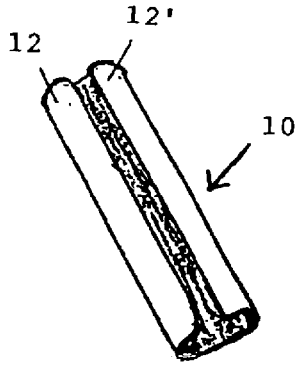
FIG. 3 shows a back view of the sliding attachment design of the belt loop cover, with two inward turned rails that slide over a belt loop, locking itself into position using a lower edge of the belt loop as a self stop.

FIG. 3 shows is a perspective view of the FIG. 1 embodiment showing rails 12, 12' at the back of belt loop cover 10.

Figure 4:
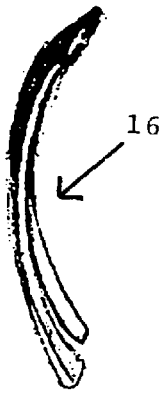
FIG. 4 shows a side view of a belt loop cover having a curved or arced face.

FIG. 4 shows an alternative embodiment 16 having a curved or art face.

Figure 5:
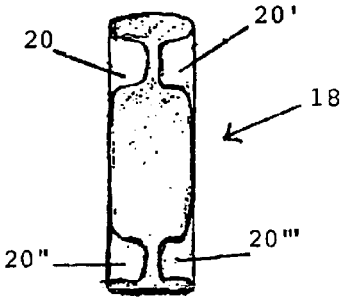
FIGS. 5–10 show alternative methods of attachment.

FIGS. 5–10 show alternative methods of attachment of the belt loop cover as follows:

FIG. 5 shows a back view of an alternative belt loop cover 18 with four pressure sensitive tabs 20, 20', 20", 20'", two at the top 20, 20' and two at the bottom 20", 20'", facing one another. The belt loop cover 18 is attached to the belt loop by pressing tabs 20, 20', 20", 20'" inward to secure and contain the belt loop.

Figure 6:
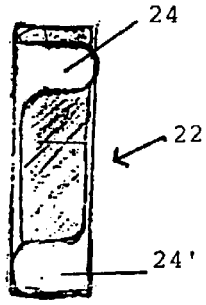

FIG. 6 shows an alternative back view of a belt loop cover 22 with an opposing tab configuration, one tab 24 positioned at the top of the belt loop and one tab 26 positioned at the bottom of the belt loop.

Figure 7:
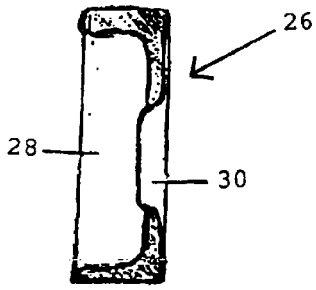

FIG. 7 shows a back view of an alternative belt loop cover 26 with a single side wrapping extension attachment 28 that goes around and over the bell loop, locking over the belt loop, locking under a catch extension 30. This could be made of metal or other bendable materials, or even of a hook and loop material.

Figure 8:
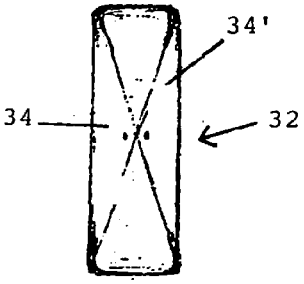

FIG. 8 shows an alternative back view of a belt loop cover 32 with two inward-turned flaps 34, 34', triangular in shape, wrapping the belt loop and meeting at the back mid-point of the belt loop.

Figure 9:
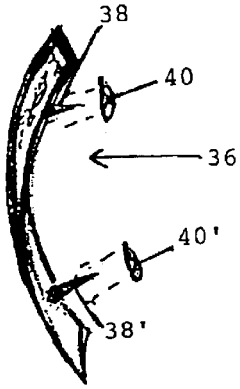

FIG. 9 shows a side view of an alternative belt loop cover 36 with a flat, but arcing or curved face. This embodiment has pin style, or screw type penetrators 38, 38' with locking covers 40, 40', to secure attachment to the belt loop.

Figure 10:
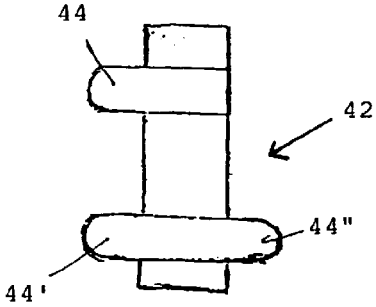

FIG. 10 shows a back view of an alternative belt loop cover 42 with three malleable tabs 44, 44', 44", which folds around the belt loop, securing the belt loop cover in place.

The tabs may have different configurations or placements and there may be a different number of tabs. The invention is not limited to the particular tab systems shown in the drawings. The belt loop covers may be used solely as the decorative element for the clothing, or may be used in conjunction with a belt, as the belt can easily slip under the belt loops and belt loop covers. In a typical jeans or pants configuration, one could use three or five belt loop covers to cover every belt loop. Any number of belt loop covers may be utilized depending on the user's desire.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A belt loop cover for a garment comprising:

a front face disposable on a front of a belt loop of the garment; and an attachment to dispose said belt loop cover on the garment belt loop, wherein the garment belt loop is attached or attachable to the garment to receive a belt passing through the belt loop.

2. The belt loop cover of claim 1 wherein said front face is flat.

3. The belt loop cover of claim 1 wherein said belt loop cover is curved.

4. The belt loop cover of claim 1 wherein said front face comprises a design at the time of manufacture.

5. The belt loop cover of claim 1 wherein said front face comprises a blank for a design after manufacture.

6. The belt loop cover of claim 1 wherein said attachment comprises longitudinal rails on each side of said belt loop cover, said rails attachable and detachable to the back of the belt loop.

7. The belt loop cover of claim 1 wherein said attachment comprises at least one bendable tab, said tab attachable and detachable to the back of the belt loop.

8. The belt loop cover of claim 7 comprising two tabs, one at a top of said belt loop cover and one at a bottom of said belt loop cover.

9. The belt loop cover of claim 8 wherein said tabs are in an opposing configuration.

10. The belt loop cover of claim 7 comprising four tabs, two at a top of said belt loop cover and two at a bottom of said belt loop cover.

11. The belt loop cover of claim 7 comprising a tab and a catch, wherein said tab is bendable around the belt loop and positioned under a catch.

12. The belt loop cover of claim 7 comprising two tabs, one on each side of said belt loop cover.

13. The belt loop cover of claim 12 wherein said tabs are triangular in shape.

14. The belt loop cover of claim 7 comprising three tabs, one tab at one end of said belt loop cover and two at another end of said belt loop cover.

15. The belt loop cover of claim 1 wherein said attachment comprises a penetrator and cover attachment.

16. The belt loop cover of claim 1 wherein said attachment comprises a hook and loop system.

17. The belt loop cover of claim 1 wherein said belt loop cover has a rectangular shape closely approximating a shape of the belt loop.

* * * * *